US009021956B1

(12) United States Patent
Chamberlain et al.

(10) Patent No.: US 9,021,956 B1
(45) Date of Patent: May 5, 2015

(54) MECHANICAL FIRING ADAPTER FOR A M81 DEVICE

(71) Applicants: Keith Chamberlain, Waldorf, MD (US); Thomas Higdon, La Plata, MD (US); Anthony Kummerer, La Plata, MD (US)

(72) Inventors: Keith Chamberlain, Waldorf, MD (US); Thomas Higdon, La Plata, MD (US); Anthony Kummerer, La Plata, MD (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 245 days.

(21) Appl. No.: 13/986,711

(22) Filed: May 3, 2013

(51) Int. Cl.
*F42C 7/12* (2006.01)
*F42D 1/04* (2006.01)
*F42B 3/26* (2006.01)

(52) U.S. Cl.
CPC .... *F42D 1/04* (2013.01); *F42C 7/12* (2013.01)

(58) Field of Classification Search
CPC ..... F42D 1/00; F42D 1/04; F42D 1/043; F42D 1/045; C06C 5/06; C06C 7/00; F41H 11/12; B63G 2007/005; F42B 3/10; F42B 3/26; F42C 7/00; F42C 7/12; F42C 14/02; F41A 19/06; F41A 19/08
USPC ..... 102/200, 204, 275.7, 275.11, 275.12, 102/301, 322, 403, 487
See application file for complete search history.

(56) References Cited

U.S. PATENT DOCUMENTS

| | | | | | |
|---|---|---|---|---|---|
| 1,278,932 | A * | 9/1918 | Hughes | 102/301 |
| 2,382,872 | A * | 8/1945 | Giles | 102/261 |
| 2,705,920 | A * | 4/1955 | Kanady | 175/4.52 |
| 3,296,968 | A * | 1/1967 | Shulman et al. | 102/204 |
| 4,306,628 | A * | 12/1981 | Adams et al. | 175/4.56 |
| 4,381,711 | A * | 5/1983 | Lawrence | 102/275.11 |
| 4,438,699 | A | 3/1984 | Nitzberg | |
| 4,520,648 | A * | 6/1985 | Gregory | 29/243.527 |
| 4,636,137 | A | 1/1987 | Lemelson | |
| 4,688,466 | A * | 8/1987 | Burkdoll et al. | 89/1.14 |
| 5,499,581 | A | 3/1996 | Sutula, Jr. | |
| 6,581,519 | B1 * | 6/2003 | Adams | 102/275.11 |
| 7,506,570 | B1 * | 3/2009 | Koski | 89/1.806 |
| 7,836,811 | B1 | 11/2010 | Gardner et al. | |
| 7,895,930 | B2 | 3/2011 | Fisk et al. | |
| 8,234,978 | B1 * | 8/2012 | Bond et al. | 102/275.11 |
| 2008/0276818 | A1 * | 11/2008 | Ballantine et al. | 102/202.1 |
| 2010/0307366 | A1 * | 12/2010 | Thomas et al. | 102/487 |

OTHER PUBLICATIONS

US Publication 2005/0126418, Initiation Fixture and an Initiator Assembly Including the Same, WO 03/071220, PCT/US03/04593, Jun. 16, 2005.

* cited by examiner

*Primary Examiner* — Bret Hayes
(74) *Attorney, Agent, or Firm* — Fredric J. Zimmerman

(57) ABSTRACT

A mechanical firing adapter for an igniter, such as an M81, to enable remotely firing the igniter using a robot, such as a MTRS. MTRS are used in the disposal/disruption of IEDs. Igniters are generally used with a shock tube, a type of fuse that is used with explosive charges, like shape charges. The adapter has a base plate with a first area to secure the igniter, a second area to withdraw the igniter's pull-rod by the attached pull-ring, and a compound assembly that interfaces with a robot. The pull-ring is attached to a sled that moves rearward when a clinching force is applied to opposing paddles, which causes the connected angled articulating struts to spread open. The paddles are moved closer by a remote controlled robotic jaw, and this closing movement causes the sled to move rearward, pulling out the pull-rod, which sets off the explosive.

21 Claims, 3 Drawing Sheets

MECHANICAL FIRING ADAPTER FOR A M81 DEVICE

STATEMENT OF GOVERNMENT INTEREST

The invention described herein may be manufactured and used by or for the Government of the United States of America for Governmental purposes without the payment of any royalties thereon or therefore.

BACKGROUND OF THE INVENTION

1. Field of the Invention

The invention relates generally to explosive tools and more particularly to a means of remotely initiating an M81 shock tube igniter.

2. Background

An M81 igniter is used to ignite a time blasting fuse or to initiate a shock tube. Shock tube is a thin plastic tube with a thin layer of special explosive material deposited on its interior surface. The standard M81 igniter has the following visible components: a small plastic tube with a pull-ring on a pull-rod projecting from one end, a safety (cotter) pin that passes through the tube, and a screw cap that secures a holding mechanism for the fuse or shock tube. The igniter can accommodate a shock tube or a time blasting fuse. A two-piece plastic plug allows proper securing of the shock tube (with just inner piece removed) or the time blasting fuse (with both pieces removed). A partially cut away prior art view of an M81 is shown in FIG. 6.

The M81 was engineered to be manually actuated by the operator. The ignition sequence is typically as follows: An operator (explosive expert) while positioning an explosive charge at the desired distance from the target, begins dispenses shock tube/time blasting fuse from the dispenser. After the explosive charge has been positioned, the operator moves away, continuing to dispense the shock tube/time blasting fuse until a sufficient pay-out length has been deployed to reach a safe area for personnel. The shock tube is then connected to the igniter. To make this connection the operator loosens the screw cap and removes some or all of the inner piece of the two-piece plastic plug, cuts off an end of the tube/fuse and inserts it in the hole from which the plug was removed. The screw cap is then re-tightened to secure the fuse or shock tube. The safety (cotter) pin can then be removed. To initiate the M81, while holding the body of the M81, the operator uses his other hand to pull on the pull-ring, which in turn pulls out the pull-rod. The pull-rod pulls the firing-pin against the force of a spring. When the limit of travel is reached, the pull-rod releases the firing-pin, which is forced by the spring into the primer, which fires with a flame and an explosive shock which ignites the fuse or initiates the shock tube, therein detonating the explosive charge.

In more recent developments, the shock tube can be manually initiated using an electrical spark produced by a sparking device attached to a robotic device. In both cases (M81 and sparking device) manual ignition is required. An example of the robotic device is the MTRS platform (Man Transportable Robotic System). Initiating shock tube by hand requires the robot operator to maneuver the robot from the target site, dispense a sufficient pay-out length until enough has been deployed for the operator to move away, while continuing the dispensing shock tube, to a safe area. This method of operation is time consuming and prevents additional investigation once the shock tube deployment begins. Another method of initiating shock tube is by an electrical spark produced by a firing device attached to the MTRS robotic platform. This method requires tethering the robot to the shock tube. The tethering prevents free movement of the robot, and is problematic. For instance, if a robot runs over the shock tube, the shock tube can become tangled in the drive tracks of the robot, limiting the robot's movement.

SUMMARY OF THE INVENTION

The disclosed invention, in one aspect, is a mechanical firing adapter for an igniter, such as M81 and M60, where the firing adapter enables the igniter to be actuated by an MTRS (Man Transportable Robotic Systems), where the MTRS is generally remotely controlled.

An igniter with the disclosed mechanical firing adapter enables a robotic arm to effect movement that simulates manual activation of legacy igniters. The robot can and usually is remotely controlled. Taken together, the invention therein is also a method to activate, remotely, an igniter fitted with the invented adapter. In another aspect, the invention uses a Man Transportable Robotic System (MTRS) platforms, which are relatively less expensive systems. The mechanical firing adapter enables the remote controlled robot to not only deploy an explosive charge to an incident site, where the incident site is where the charge is detonated, but the igniter and shock tube can also be deployed by using the MTRS. The operator is positioned at a safe distance, and the robot can maneuver freely until the explosive has been set up and conditions are ready to fire the explosive charge. The robot's distance to a safe location is significantly closer to the incident site than what is consider acceptably safe for personnel.

The mechanical firing adapter, in another aspect, includes a base plate with a first area with a frame for fastening the igniter to a front-side of the base plate; a second area for withdrawing the pull-rod axially from the igniter, where upon being withdrawn to a limit of travel, the igniter is activated. The second area generally includes a plurality of elongate slots, where each elongate slot has a length that is at least as long as the limit of travel. A compound assembly completes the interface between the robot and the igniter. Robots typically have an arm with a clamping jaw with a closing action for picking up items. When the jaw is closed the compound assembly converts the closing action into a substantially linear movement that is orthogonal to the closing action. The linear movement causes a controlled withdrawal of the pull-rod from the igniter.

The compound assembly includes a sled element that can linearly move across the base plate tracking along a medial line. The sled element has a medial hitch onto which the pull-ring can be attached, and the elongate slots serve as a tracking mechanism for the sled element to connect to the base plate. The compound assembly includes a pair of opposing paddles conformed to be simultaneously held and brought towards each other when the robotic jaw closes. Each of the pair of opposing paddles is attached to at least two articulating struts, at least one to the front and at least one to the rear, such that the front and rear struts are angled with respect to each, and when the angle between struts is small the distance between opposing paddles is much larger than when the angle is larger. As will be shown, a relatively small decrease in the distance between opposing paddles produces a significant opening of the angle and spreading of the front and rear struts.

The movement of the struts is possible, because each strut is pivotal on both ends, and at least one front articulating strut is pivotally attached to a front pivotal pin on the paddle, and the strut extends forward to a front pin on the first area of the base plate. At least one rear articulating strut is pivotally attached to a rear pin on the paddle and the rear strut extends rearward to a sled pin.

When a clinching force is applied by the robotic jaw, such as by a pair of opposing surfaces on hydraulic pistons or motorized geared jaws, the pair of opposing paddles move toward each other causing the articulating elements to spread, therein forcing the sled element, which as previously described is connected to the rear struts with rear pivotal pins, to move toward the rear. The pull-ring is jointly attached to the sled's medial hitch and the pull-rod, movement of the sled to the rear withdraws the pull-rod, quickly reaching the limit of travel. Accordingly, the pull-rod releases the firing pin, which is forced by the spring into the primer. The primer fires with a flame and an explosive shock, that will ignite an attached fuse or an attached shock tube.

In another aspect, the invention is a method to activate, remotely, an igniter mounted on the invented adapter. The method may include using the MTRS to place an explosive charge and dispense the shock tube from a dispenser; setting down the dispenser down; and using the MTRS to perform other functions; paying out additional shock tube if required; and using the MTRS to robotically initiate the shock tube.

Among other advantages, the mechanical firing adapter for an M81 device provides a means of mechanically initiating an M81 shock tube igniter remotely with the Man Transportable Robotic System (MTRS) platforms. This configuration allows an operator to deploy a robot to an incident site, and both the operator and robot may maneuver freely until it is time to fire the explosive charge. The robot may be moved to a safe location, where the robot may use the adapter to initiate, mechanically, the shock tube initiation system.

BRIEF DESCRIPTION OF THE DRAWINGS

The foregoing invention will become readily apparent by referring to the following detailed description and the appended drawings in which.

DETAILED DESCRIPTION OF THE INVENTION

The mechanical firing adapter provides the compatibility of using a robotic arm to utilize legacy igniters, such as a M81, where generally the igniter is in communication with an explosive charge via a shock tube that is connected on one end to the igniter and on a distal end of the shock tube is connected to the explosive charge. The legacy igniter is defined herein to mean that it was originally engineered for manual activation. The compatibility eliminates the need for manual activation of the igniter, and this feature enables the use of a shorter length of shock tube with less exposure of personnel to a potentially dangerous target area/incident site. The invented mechanical firing adapter provides a mechanism for using remotely controlled robots to conduct, effectively, a nominally manual operation robotically. The net effect is the continued use of the igniter, like the M81, thus extending the useful life of a stock piled standard item, preventing its obsolescence, and providing Man Transportable Robotic System (MTRS) platforms with a new tool for other possible applications. The invention is also a method to activate, remotely, an igniter fitted with the invented adapter, and in so doing reduce the chance of a robot's tracks and other components to be snarled by the shock tube.

Figure 2:
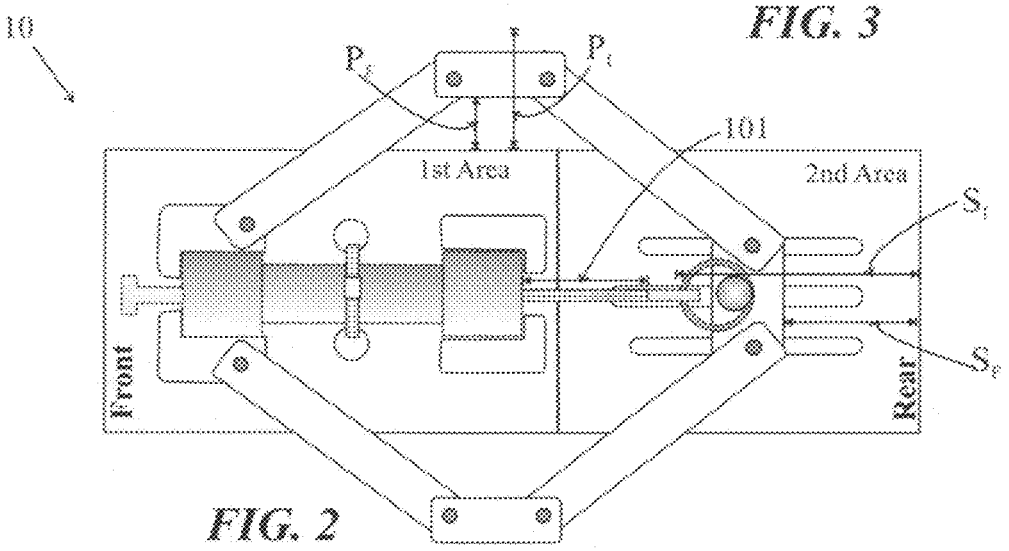
FIG. 2 is an elevational perspective view of the exemplary embodiment shown in FIG. 1, wherein the paddles have been moved closer together.
Figure 6:
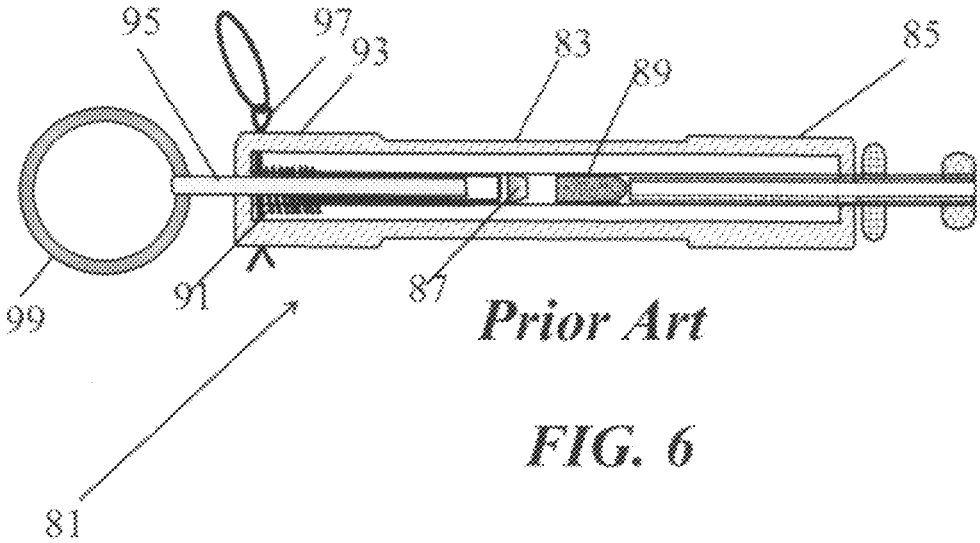
Prior Art FIG. 6
FIG. 6 is a substantially cut-away planar view of an igniter such as M60 or M81, wherein the igniter has a body with a primer end with a firing-pin, a primer, a spring, and an opposing end having a safety cotter pin, pull-rod with an attached pull-ring.

As shown in FIG. 6, the legacy igniter 81 has a body 83 with a primer end 85 with a firing-pin 87, a primer 89, a spring 91, and an opposing end 93 having a pull-rod 95 with an attached safety cotter pin 97, a pull-ring 99 and a limit of travel 101 as shown in FIG. 2.

Figure 1:
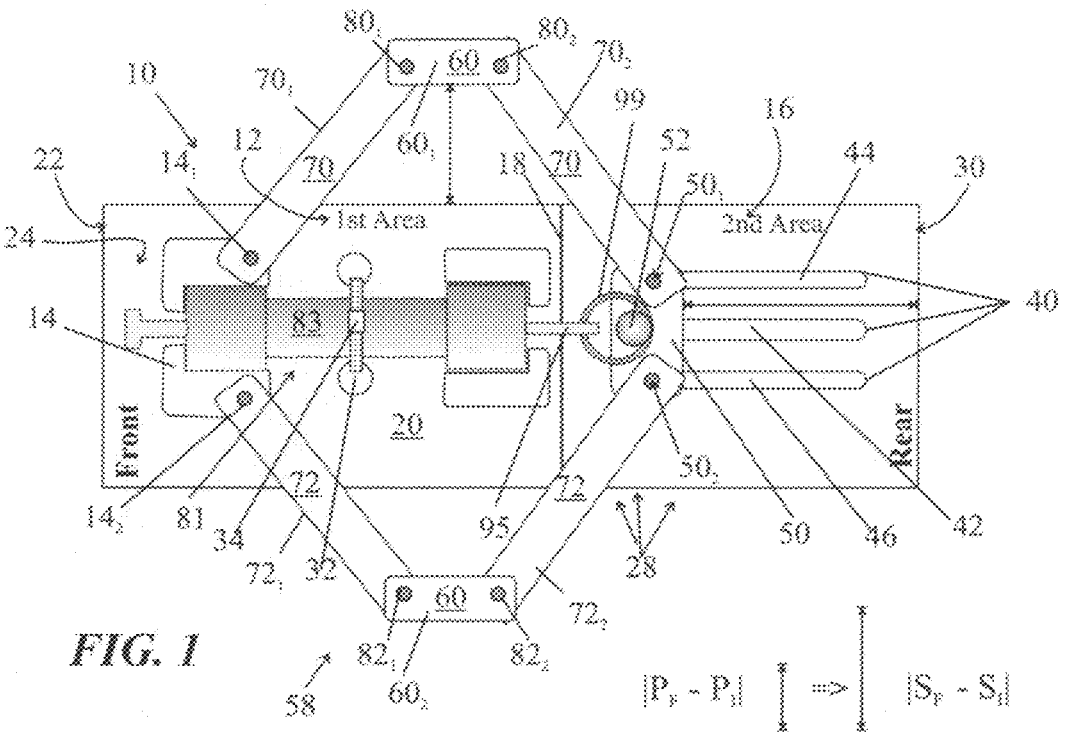
FIG. 1 is an elevation perspective view of an exemplary embodiment of the invented mechanical firing adapter for an igniter, as exemplified by an M81 device, wherein the drawing, taken with FIG. 2 and FIG. 3, illustrates that a relatively small movement by the paddles toward each other creates enough linear translational movement of the sled element to pull the pull-rod far enough out to activate the igniter.

Referring to FIG. 1, the firing adapter 10 includes: a base plate 20 having a front edge 22, a front-side 24, a back-side 26 (See FIG. 4), a perimeter edge 28, and a rear edge 30. The legacy igniter 81 is not an element of the invention, and as such it is shown with dashed lines. The illustrated base plate 20 is substantially rectangular, but other shapes are anticipated. For instance, a round base plate would provide improved lateral stability. The base plate could also have legs, and more than one layer.

The mechanical firing adapter 10 has a first area 12. Included in the first area 12 is a frame 14, functionally dimensioned to secure the igniter 81 on the front-side 24 of the base plate 20. The front side 24 of the base plate 20 has eyelets 32 through which a cable strap 34 is cinched around the igniter's body 83, further securing the igniter 81 in the frame 14. A second area 16 of the plate 20 is used to withdraw the pull-rod 95 axially from the igniter's body 83, where upon being retracted a distance that is the limit of travel 101 (as shown in FIG. 2), the igniter 81 is activated. The second area 16 includes a plurality of elongate slots 40, which are apertures extending through the base plate, where each elongate slot has a length that is at least as long as the distance of the limit of travel. The illustrated slots include a medial first slot 42, where the medial first slot extends lengthwise, aligned coplanar with the pull-rod. Additionally, there is a lateral second slot 44 and a lateral third slot 46. The lateral slots 44,46 are substantially parallel to the medial slot 42. The medial slot substantially bisects the lateral slots 44,46. Cumulatively, the elongate slots serve as a tracking mechanism for the sled element to connect to the base plate.

The firing adapter 10 has a compound assembly 58 that when clinched converts a closing action into a linear movement that is a substantially orthogonal to the closing action.

The linear movement produces a controlled withdrawal of the pull-rod from the igniter. The compound assembly includes a sled element 50 that may be linearly moved across the base plate 20, tracking along the medial first slot 42. The sled element 50 has a medial hitch 52 onto which the pull-ring can be attached. There are a pair of opposing paddles 60 conformed to be held and clinched by a single robotic jaw (not show), where a first paddle $\mathbf{60}_1$ is attached to at least two articulating first struts $\mathbf{70}_1$,$\mathbf{70}_2$. Each first strut is pivotal on both ends, and at least one front articulating first strut $\mathbf{70}_1$ is pivotally attached to a first front pin $\mathbf{80}_1$ of the first paddle $\mathbf{60}_1$ and extends to the first area of the base plate where it is pivotally attached to a first block pin $\mathbf{14}_1$. The first block pin $\mathbf{14}_1$ projects substantially perpendicular from the base plate and is located proximate to a primer end 85 (see FIG. 6) of the frame 14. At least one rear articulating first strut $\mathbf{70}_2$ is pivotally attached to a rear pin $\mathbf{80}_2$ of the first paddle $\mathbf{60}_1$ and extends to the second area of the base plate where it is pivotally attached to a first sled pin $\mathbf{50}_1$. The first sled pin $\mathbf{50}_1$ projects substantially perpendicular from the sled 50 and is located approximately lateral to the medial hitch 52 and substantially over the lateral second slot 44. A second paddle $\mathbf{60}_2$, that is substantially a mirror of the first paddle $\mathbf{60}_1$, is attached to at least two articulating second struts 72. Each second strut 72 is pivotal on both ends, where at least one front articulating second strut $\mathbf{72}_1$ is pivotally attached to a front pin $\mathbf{82}_1$ of the second paddle $\mathbf{60}_2$ and extends to the first area 12 of the base plate where it is pivotally attached to an opposing first block pin $\mathbf{14}_2$. The opposing first block pin $\mathbf{14}_2$ projects substantially perpendicular from the base plate 20 and it is located proximate to the other side of the primer end 85 of the frame 14. There is at least one rear articulating second strut $\mathbf{72}_2$ pivotally attached to a rear pin $\mathbf{82}_2$ of the second paddle $\mathbf{60}_2$. The strut $\mathbf{72}_2$ extends to the second area 16 of the base plate 20, where it is pivotally attached to a second sled pin $\mathbf{50}_2$. The second sled pin $\mathbf{50}_2$ projects substantially perpendicular from the sled 50 and it is located on the opposing side of the sled element, approximately lateral to the medial hitch 52 and substantially over the lateral third slot 46.

When a clinching force is applied by the jaw on the robotic arm, the pair of opposing paddles, $\mathbf{60}_1$ and $\mathbf{60}_2$, move toward each other causing the articulating elements 70 to spread, therein forcing the sled element to move away from the first area of the base plate toward the rear edge 30.

The pull-ring, which is jointly attached to the sled's medial hitch and the pull-rod, withdraws the pull-rod, quickly reaching the limit of travel 101 (as shown in FIG. 2). On reaching the limit of travel, the pull-rod releases the firing pin 87 (see FIG. 6), which is forced by the spring 91 into the primer 89, which fires with a flame and an explosive shock that will ignite an attached fuse or an attached shock tube.

Figure 3:
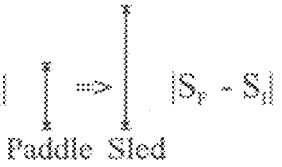
FIG. 3 is a diagrammatic comparison of movement of each paddle and the sled element, where, in the illustrated embodiment, the sled element moves about twice as far as the movement by a single paddle.

Referring to FIG. 2, which is an elevational perspective view of the exemplary embodiment shown in FIG. 1, wherein the paddles have been partially moved together, causing the rearward movement of the sled. In FIG. 1, each of the paddles are initially about 0.875 inches ($P_I$), as measured from an inner bottom edge of a paddle to a lateral edge of the base plate. In FIG. 2 each of the paddles are closer, about ~0.5 inches ($P_F$) as measured from an inner bottom edge of a paddle to a lateral edge of the base plate. The net movement of each paddle is about ~0.375 inches closer to the lateral edge. In FIG. 1, the sled element, as measured from a rear edge of the sled element to a rear edge 30 of the base plate was initially about 1.685 inches ($S_I$); and in FIG. 2 the distance to the rear edge is about 0.875 inches ($S_F$). The net change for each paddle is the absolute value $|P_F-P_I|$ or (0.875-0.50), which is about 0.375 inches. The net change for the sled element is the absolute value $|S_F-S_I|$ or (1.685-0.875), which is about ~0.81 inches. So, the sled element moves about twice as far as a paddle. This configuration is shown in FIG. 3. The limit of travel 101 is, of course, sign sensitive, as the pull-rod has to be withdrawn a finite distance, or else the firing pin will not be released, hence the use of the absolute brackets. As is evident from FIG. 2, there is still at least another 0.875 inches left in reserve. If more travel is desired, the invented adapter may be scaled up, and the struts may be made even longer. The adapter is dimensioned according to the requirements of the task.

Figure 4:
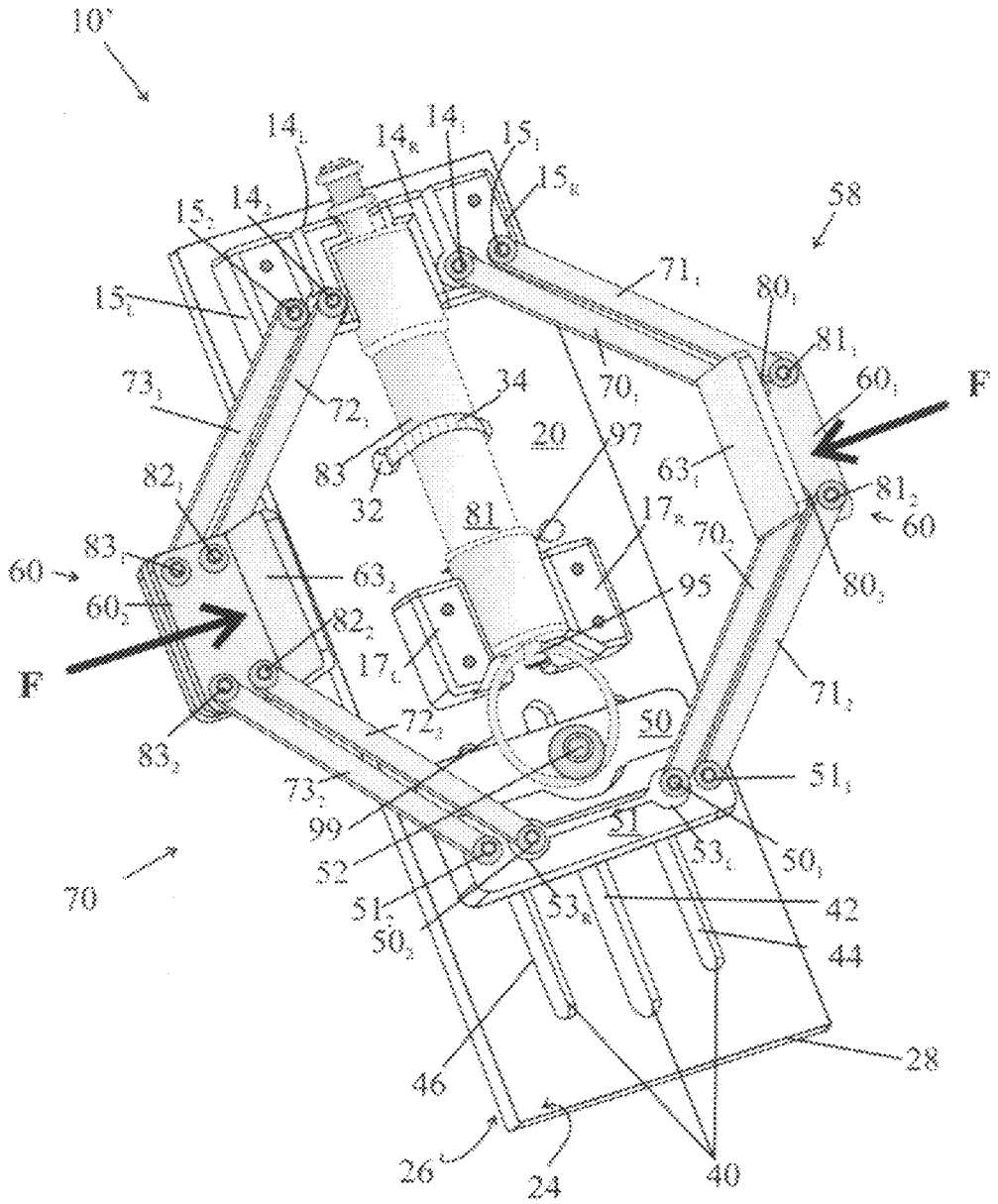
FIG. 4 is an elevation perspective view of another exemplary embodiment of the invented mechanical firing adapter for an igniter, as exemplified by an M81 device, wherein the articulating elements are paired, producing twice as many articulating elements with much improved torsional resistance, and a much more complex sled element.

Referring to FIG. 4, which is an elevation perspective view of another exemplary embodiment of the invented mechanical firing adapter 10' for an igniter. In the current illustrated embodiment, there are a plurality of paired articulating elements, which imparts much improved torsional resistance, and overall improved ruggedness. The compound assembly 58 has a sled 50 with a traveler 51. The mechanical firing adapter is fitted with an igniter 81 having a body 83. In the illustrated embodiment, the cotter safety pin 97 is still in place. The base plate has a front-side 24, a back-side 26, and a perimeter edge 28. As before, the base plate has substantially two functional areas. There is a first area that includes framing elements $\mathbf{14}_L$, $\mathbf{14}_R$, $\mathbf{17}_L$ and $\mathbf{17}_R$, where framing elements $\mathbf{14}_L$, $\mathbf{14}_R$ secure the primer end of the igniter (the primer end connects to the shock tube), and the opposing framing elements $\mathbf{17}_L$, $\mathbf{17}_R$, which secure the opposing end of the igniter. In the illustrated embodiment, the eyelet 32 has a cinched cable tie 34 securing the body 83 of the igniter to the front-side 24 of the base plate 20. Additionally, there are blocks $\mathbf{15}_L$,$\mathbf{15}_R$ which are lateral to the framing elements $\mathbf{14}_L$,$\mathbf{4}_R$, which in effect elevate and support the front bearing pins for some of the articulating struts.

There is a second area for withdrawing the pull-rod 95 axially from the igniter. As previously discussed, upon being withdrawn a distance that is a limit of travel, the igniter is activated. The second area includes a plurality of elongate slots 40, which are apertures extending through the base plate. Each elongate slot has a length that is at least as long as the distance of the limit of travel. The illustrated elongate slots include a medial first slot 42 that extends lengthwise. It is substantially aligned coplanar with the pull-rod 95. Also shown are a lateral second slot 44 and a lateral third slot 46, where the lateral slots 44,46 are substantially parallel to the medial slot 42. The medial slot 42 essentially bisects the lateral slots 44, 46.

The mechanical firing adapter has a compound assembly 58 that when force is applied as shown in the direction indicated by the large black arrows labeled F, the force produces a closing action. This closing action is converted into a substantially orthogonal linear movement. The linear movement produces a controlled withdrawal of the pull-rod from the igniter's body.

Figure 5B:
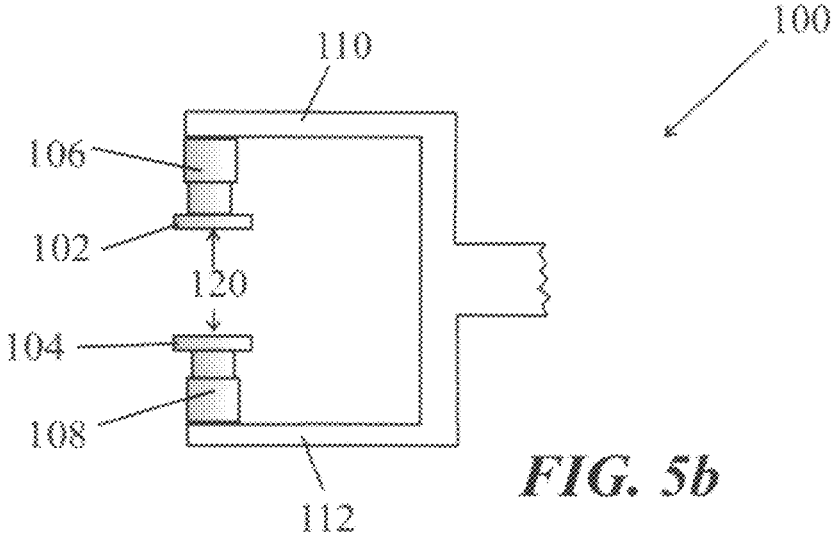
FIG. 5*b* is a substantially planar view of the clamping jaw shown in FIG. 5*a*, where the pistons have been actuated, causing the gap between the jaws to be significantly reduced.
Figure 5A:
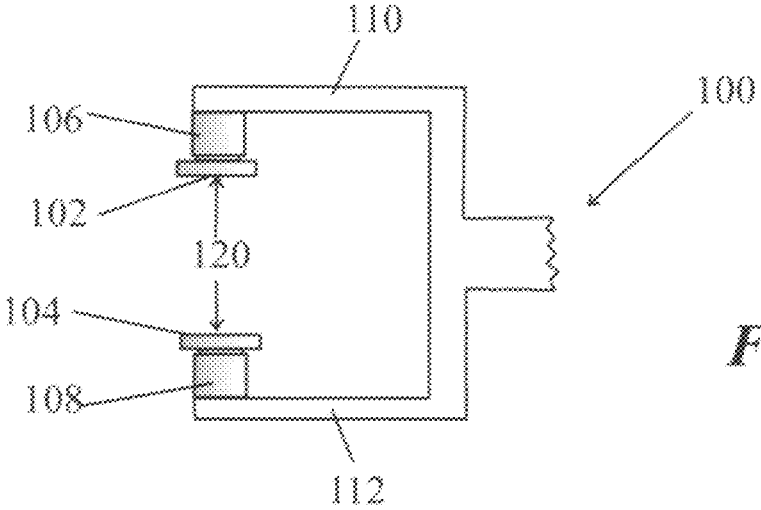
FIG. 5*a* is a substantially planar view of a robotic arm with a clamping jaw, wherein the jaw is open.

The sled element 50, pushed by the articulating struts, moves linearly across the base plate, tracking along the medial first slot 42. The sled element 50 has a medial hitch 52 onto which the pull-ring can be attached. The assembly has a pair of opposing paddles 60, where each paddle $\mathbf{60}_1$,$\mathbf{60}_2$ is substantially lateral to the frame. Each paddle $\mathbf{60}_1$,$\mathbf{60}_2$ has a vertical base $\mathbf{63}_1$,$\mathbf{63}_2$ that enables a robotic arm with a hand or jaw to grasp and close the opposing paddles 60. FIG. 5*a* and FIG. 5*b* illustrate a portion of a robotic arm with a clamping jaw. The pivoting articulating struts $\mathbf{70}_1$,$\mathbf{71}_1$ and $\mathbf{70}_2$,$\mathbf{71}_2$, on the first paddle $\mathbf{60}_1$ has an outer front pin $\mathbf{81}_1$, an inner front pin $\mathbf{80}_1$, an outer rear pin $\mathbf{81}_2$ and an inner rear pin $\mathbf{80}_2$. The inner pins $\mathbf{80}_1$ and $\mathbf{80}_2$ are barely visible, obscured by the vertical base $\mathbf{63}_1$. The pairs of articulating first struts are substantially parallel. Each strut is pivotal on both ends. The pairs of articulating first struts include an outer front first strut $\mathbf{71}_1$, an inner front first strut $\mathbf{70}_1$, an outer rear first strut $\mathbf{71}_2$, and an inner rear first strut $\mathbf{70}_2$. The outer front first strut $\mathbf{71}_1$ extends from paddle pin $\mathbf{81}_1$ to the front of the base plate 20 where it is pivotally attached to a right block pin $\mathbf{15}_1$ protruding from a lateral right block $\mathbf{15}_R$. The right block pin $\mathbf{15}_1$ projects substantially perpendicular from the base plate 20, and it located proximate to the front end of the frame. The inner front first strut $\mathbf{70}_1$ extends from paddle pin $\mathbf{80}_1$ to the front of the base plate where it is pivotally attached to a first bearing pin $\mathbf{14}_1$. The first bearing pin $\mathbf{14}_1$ projects substantially perpendicular from the base plate and is located proximate to the right framing element $\mathbf{14}_R$. The outer rear first strut $\mathbf{71}_2$ extends rearward from paddle pin $\mathbf{81}_2$ to the second area of the base plate and is pivotally attached to a first traveler pin $\mathbf{51}_1$. The traveler 51 is seated on the sled element 50, and the first traveler pin $\mathbf{51}_1$ projects substantially perpendicular from the traveler 51. Its position is substantially lateral to the medial hitch 52, and substantially lateral to the lateral second slot 44. The inner rear first strut $\mathbf{70}_2$ extends from paddle pin $\mathbf{80}_2$ to the second area of the base plate and is pivotally attached to a first sleeved bearing pin $\mathbf{50}_1$ that is seated in a first lateral aperture $\mathbf{53}_R$. The first lateral aperture $\mathbf{53}_R$ is substantially aligned with the lateral second slot 44.

The second paddle $\mathbf{60}_2$ has an outer front second pin $\mathbf{83}_1$, an inner front second pin $\mathbf{82}_1$, an outer rear second pin $\mathbf{83}_2$ and an inner rear second pin $\mathbf{82}_2$ to which are attached two pairs of parallel articulating second struts, where each strut is pivotal on both ends. The pairs of articulating second struts includes an outer front second strut $\mathbf{73}_1$, an inner front second strut $\mathbf{72}_1$, an outer rear second strut $\mathbf{73}_2$, and an inner rear second strut $\mathbf{72}_2$. The outer front second strut $\mathbf{73}_1$ extends from paddle pin $\mathbf{83}_1$ to a left block pin $\mathbf{15}_1$ protruding from a lateral left block $\mathbf{15}_L$. The left block pin $\mathbf{15}_1$ projects substantially perpendicular from the base plate 20, and it located proximate to the front end of the frame. The inner front second strut $\mathbf{72}_1$ extends from paddle pin $\mathbf{82}_1$ to the front of the base plate where it is pivotally attached to a second bearing pin $\mathbf{14}_2$. The second bearing pin $\mathbf{14}_2$ projects substantially perpendicular from the base plate and is located proximate to framing element $\mathbf{14}_L$. The outer rear second strut $\mathbf{73}_2$ extends from paddle pin $\mathbf{83}_2$ to a second traveler pin $\mathbf{51}_2$. The second traveler pin $\mathbf{51}_2$ is located substantially lateral to a rear of the medial hitch 52 and substantially lateral to the lateral third slot 46. The inner rear second strut $\mathbf{72}_2$ extends from paddle pin $\mathbf{82}_2$ to the second area of the base plate, and it is pivotally attached to a second sleeved bearing pin $\mathbf{50}_2$ seated in a second lateral aperture $\mathbf{53}_L$. The second lateral aperture $\mathbf{53}_L$ is substantially aligned with the lateral third slot 46.

Referring to FIG. 5*a*, this figure is a substantially planar view of an actuatable clamping jaw 100. The clamping jaw 100 has a right plate element 102 seated on a first actuatable piston 106, where the first actuatable piston 106 is mounted on one side 110 of the clamping jaw 100. An opposing left plate element 104 is seated on a second actuatable piston 108 mounted on an opposing side 112 of the clamping jaw 100, where both the first actuatable piston 106 and the second actuatable piston 108 are retracted.

Referring to FIG. 5*b*, the pistons 106, 108 have been actuated, and are fully extended, narrowing a gap 120 between the right plate element 102 and the opposing left plate element 104.

The invention further includes a method of igniting an explosive charge. The method may include the steps of providing an explosive charge, a length of shock tube spooled on a dispenser, an igniter (such as M81) having a body with a primer end for attaching the shock tube and an opposing end having a pull-rod with an attached pull-ring, and a safety cotter pin, and a mechanical firing adapter to which can be fastened the igniter. The mechanical firing adapter has a base plate with a first area for securing the igniter, a second area including a sled element with a hitch to which the pull-ring can be fastened, and a compound assembly of opposing paddles connected to articulating struts. The struts convert a jaw-like closing motion of the paddles by a robotic arm into a translational linear movement of the sled element therein withdrawing the pull-rod. The method further includes attaching the shock tube to the igniter; and confirming the paddles are in the fully open position. The sled element is proximate to the first area. The method further includes attaching the igniter to the mechanical firing adapter; confirming by an inspection by a robot that an explosive charge may be moved close enough to the target to be effective, where during the inspection, the shock tube may be dispensed; setting up the explosive charge and connecting the shock tube to the explosive charge. The method further includes dispensing additional shock tube as needed; positioning the mechanical firing adapter such that the paddles are accessible and confirming that there is no clinching force on the paddles; confirming that a safety area is still clear; removing the safety pin; providing an additional safe region for any personnel; and closing the paddles utilizing a remote controlled robotic jaw, therein detonating the explosive charge.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A mechanical firing adapter for an igniter, where said igniter has a body with a primer end with a firing-pin, a primer, a spring, and an opposing end having a pull-rod with an attached safety cotter pin, and a pull-ring, comprising:

a base plate having a front-side, a back-side, a perimeter edge, where said base plate is comprised of two functional areas:

a first area comprising a frame, functionally dimensioned to secure the igniter on the front-side of the base plate, and a second area to withdraw the pull-rod axially from the igniter, where upon being withdrawn a distance that is a limit of travel, the igniter is activated, said second area comprising three elongate slots, which are apertures extending through the base plate, where each elongate slot has a length that is at least as long as the distance of the limit of travel, said elongate slots comprising a medial first slot, said medial first slot extending lengthwise aligned coplanar with the pull-rod, a lateral second slot and a lateral third slot, wherein said lateral slots are substantially parallel to the medial slot, said medial slot bisecting the lateral slots;

a compound assembly that when clinched converts a closing action into a linear movement that is substantially orthogonal to the closing action, said linear movement producing a controlled withdrawal of the pull-rod from the igniter, where said compound assembly comprises:

a sled element that under force will move linearly across the base plate, tracking along the medial first slot, said sled element having a medial hitch onto which the pull-ring can be attached, a pair of opposing paddles conformed to be held and then clinched by a robotic jaw, where a first paddle is attached to at least two articulating first struts, where each first strut is pivotal on both ends, and where at least one front articulating first strut is pivotally attached to a first front pin of the first paddle and the front strut extends forward from the first paddle to a first block pin, said first block pin projecting substantially perpendicular from the base plate and located proximate to a primer end of the frame, where at least one rear articulating first strut is pivotally attached to a rear pin of the first paddle and extends rearward from the first paddle to a first sled pin, said first sled pin projecting substantially perpendicular from the sled element and located lateral to the medial hitch and substantially over the lateral second slot, and where a second paddle, that is substantially a mirror of the first paddle, is attached to at least two articulating second struts and each second strut is pivotal on both ends, where at least one front articulating second strut is pivotally attached to a front pin of the second paddle and extends forward from the second paddle to an opposing first block pin, said opposing first block pin projecting substantially perpendicular from the base plate and located proximate to an opposing side of the primer end of the frame, where at least one rear articulating second strut is pivotally attached to a rear pin of the second paddle and extends rearward from the second paddle to a second sled pin, said second sled pin projecting substantially perpendicular from the sled element and located on the opposing side of the sled element, lateral to the medial hitch and substantially over the lateral third slot;

wherein, when a clinching force is applied by the robotic jaw, the pair of opposing paddles move toward each other causing the articulating struts to spread, therein forcing the sled element to move rearward, the pull-ring jointly attached to the sled's medial hitch and the pull-rod, withdrawing the pull-rod, quickly reaching the limit of travel, whereupon the pull-rod releases a firing pin, which is forced by a spring into the primer, which fires with a flame and an explosive shock, that will ignite an attached fuse or an attached shock tube.

2. The mechanical firing adapter according to claim 1, wherein the medial hitch is a flared post seated in the sled element.

3. The mechanical firing adapter according to claim 1, further comprising a traveler being seated on the sled element, wherein said traveler has a second lateral aperture that is aligned with the lateral second slot and a third lateral aperture that is aligned with the third slot, where a first sleeved bearing pin and a second sleeved bearing, pin connect and guide the traveler through the second slot and the third slot when force is produced by the articulating struts that are pivotally connected to the first sleeved bearing pin and the second sleeved bearing pin.

4. The mechanical firing adapter according to claim 1, wherein the igniter is an M81.

5. The mechanical firing adapter according to claim 1, wherein the igniter is an M60.

6. The mechanical firing adapter according to claim 1, wherein the base plate has an eyelet through which passes one of a fastening tie and a fastening clip to augment securing the igniter.

7. The mechanical firing adapter according to claim 1, wherein each paddle has a vertical base that facilitates aligning and holding the opposing paddles.

8. A mechanical firing adapter for an igniter, where said igniter has a body with a primer end with a firing-pin, a primer, a spring, and an opposing end having a pull-rod with an attached safety cotter pin, a pull-ring, comprising:

a base plate having a front-side, a back-side, a perimeter edge, where said base plate is comprised of two functional areas:

a first area comprising a frame, where the frame secures the igniter on the front-side of the base plate, and a second area to withdraw the pull-rod axially from the igniter, where upon being withdrawn a distance that is a limit of travel, the igniter is activated, said second area comprising three elongate slots, which are apertures extending through the base plate, where each elongate slot has a length that is at least as long as the distance of the limit of travel, said elongate slots comprising a medial first slot, said medial first slot extending lengthwise substantially aligned coplanar with the pull-rod, and a lateral second slot and a lateral third slot, wherein the lateral slots are substantially parallel to the medial slot, said medial slot bisecting the lateral slots;

a compound assembly that when clinched converts a closing action into a linear movement that is a substantially orthogonal to the closing action, said linear movement producing a controlled withdrawal of the pull-rod from the igniter, where said assembly comprises:

a sled element that can be linearly moved across the base plate tracking along the medial first slot, said sled element having a medial hitch onto which the pull-ring can be attached, a pair of opposing paddles that are substantially lateral to the frame, said opposing paddles conformed to be carried with minimal clinching force and responsive when clinched by a robotic jaw;

where a first paddle has an outer front pin, an inner front pin, an outer rear pin and an inner rear pin to which are attached two pairs of parallel articulating first struts, where each strut is pivotal on both ends, said pairs of articulating first struts comprised of an outer front first strut and an inner front first strut, and an outer rear first strut and an inner rear first strut, where the outer front first strut extends forward from the first paddle outer front pin to a right block pin, said right block pin projecting substantially perpendicular from a right block located proximate to the front of the base plate, where the inner first strut extends forward from the first paddle inner front pin to the first bearing pin projecting substantially perpendicular from the base plate and located proximate to the frame, where the outer rear first strut extends rearward from the first paddle outer rear pin to a first traveler pin, where the traveler is seated on the sled element, said first traveler pin projecting substantially perpendicular from the traveler and located lateral to the medial hitch and substantially lateral to the lateral second slot, where the inner rear first strut extends rearward from the first paddle inner rear pin to a first sleeved bearing pin that is seated in a second lateral aperture that is aligned with the lateral second slot;

where a second paddle has an outer front second pin, an inner front second pin, an outer rear second pin and an inner rear second pin to which are attached two pairs of parallel articulating second struts, where each strut is pivotal on both ends, said pairs of articulating second struts comprised of an outer front second strut and an inner front second strut, and an outer rear second strut and an inner rear second strut, where the outer front second strut extends forward from the second paddle outer front pin to a left block pin, said left block pin projecting substantially perpendicular from a left block located proximate to the front of the base plate, where the inner second strut extends forward from second paddle inner front pin to the second bearing pin projecting substantially perpendicular from the base plate and located proximate to the frame, where the outer rear second strut extends rearward from the second paddle outer rear pin to a second traveler pin, said second traveler pin projecting substantially perpendicular from the traveler and located lateral to the medial hitch and substantially lateral to the lateral third slot, where the inner rear second strut extends rearward from the second paddle inner rear pin to a second sleeved bearing pin that is seated in a third lateral aperture that is aligned with the lateral third slot;

wherein, when a clinching force is applied by the robotic jaw, the pair of opposing paddles move toward each other causing the articulating struts to spread, therein forcing the sled element to move rearward, the pull-ring jointly attached to the sled's medial hitch and the pull-rod, withdrawing the pull-rod, quickly reaching the limit of travel, whereupon the pull-rod releases a firing pin, which is forced by a spring into the primer, which fires with a flame and an explosive shock, that will ignite an attached fuse or an attached shock tube.

9. The mechanical firing adapter according to claim 8, wherein the igniter is an M81.

10. The mechanical firing adapter according to claim 8, wherein the igniter is an M60.

11. The mechanical firing adapter according to claim 8, wherein the base plate has an eyelet through which passes one of a fastening tie and a fastening clip to augment securing the igniter.

12. The mechanical firing adapter according to claim 8, wherein each paddle has a vertical base that facilitates aligning and holding the opposing paddles.

13. The mechanical firing adapter according to claim 8, wherein the base has an eyelet, through which a fastening element connects the igniter to the front-side of the base plate.

14. The mechanical firing adapter according to claim 8, wherein a closing length of movement of the first paddle toward the second paddle causes the sled element to move a rearward length that is about twice the closing length of movement of the first paddle.

15. The mechanical firing adapter according to claim 8, wherein the right block elevates the outer front first strut and the left block elevates the outer front second strut.

16. The mechanical firing adapter according to claim 8, wherein the traveler on the sled element elevates the outer rear first strut and the outer rear second strut.

17. The mechanical firing adapter according to claim 8, wherein the first bearing pin elevates the inner front first strut and the second bearing pin elevates the inner front second strut.

18. The mechanical firing adapter according to claim 8, wherein the first sleeved bearing pin elevates the inner rear first strut and the second sleeved bearing pin elevates the inner rear second strut.

19. A method of igniting an explosive charge, comprising:

providing an explosive charge, a length of shock tube spooled on a dispenser, an igniter (such as M81) having a body with a primer end for attaching the shock tube and an opposing end having a pull-rod with an attached pull-ring, and a safety cotter pin, and a mechanical firing adapter to which can be fastened the igniter, where said mechanical firing adapter has a base plate with a first area for securing the igniter, a second area comprised of a sled element with a hitch to which the pull-ring can be fastened, and a compound assembly of opposing paddles connected to articulating struts that converts a closing action of the paddles by a robotic jaw into a translational linear rearward movement of the sled element, thereby withdrawing the pull-rod;

attaching the shock tube to the igniter;

confirming that the paddles are in the fully open position, and that the sled element is proximate to the first area;

fitting the igniter with the mechanical firing adapter;

using a robot making an inspection that confirms that an explosive charge can be moved close enough to a target to be effective, where during said inspection the shock tube can be dispensed;

setting up the explosive charge with the shock tube connected to the explosive charge;

dispensing additional shock tube as needed;

positioning the mechanical firing adapter such that the paddles are accessible;

confirming that a safety area is still clear;

removing a safety pin that can be the safety cotter pin;

confirming that an incident site, which includes the explosive charge and the target, is clear of all personnel; and closing the paddles using a remote controlled robotic jaw, therein actuating the igniter.

20. The method of igniting an explosive charge according to claim 19, further comprising utilizing said mechanical firing adapter reduces the length of shock chord required, utilizes legacy igniters, and reduces the danger to personnel.

21. A mechanical firing adapter for an igniter, where said igniter includes a body with a primer end with a firing-pin, a primer, a spring, and an opposing end having a pull-rod with a pull-ring, comprising:

a base plate having a front-side, a back-side, a perimeter edge, wherein said base plate is comprised of a first area and a second area, which form two functional areas, wherein said first area comprises a frame for the primer end and the opposing end, functionally dimensioned to immobilize the igniter on the front-side of the base plate, and a second area where the pull-rod is capable of being axially withdrawn from the igniter a distance that is a limit of travel; and a compound assembly comprising a sled element and a pair of opposing lateral paddles, wherein said sled element, which has a tracking mechanism connects the sled element to the base plate, and is capable of translational motion aligned to withdraw the pull-rod, said sled element includes a medial hitch onto which the pull-ring can be attached, where when said sled element is acted on by a sufficient rearward force, said sled element moves rearward and linearly, withdrawing the pull-rod, wherein said pair of opposing lateral paddles conforms to be held and clinched by a robotic jaw, where each paddle is attached to at least two articulating struts, where each strut is pivotal on both ends, where at least one articulating strut is pivotally attached to a lateral paddle and extends forward to a base plate pin projecting substantially perpendicular and proximate to the primer end of the frame, and another of said at least one articulating strut is pivotally attached to the paddle and extends rearward to a sled pin, said sled element pin projecting substantially perpendicular from the sled and located lateral to the medial hitch, and wherein, when a clinching force is applied by the robotic jaw, the pair of opposing paddles move toward each other causing the articulating elements to spread, therein forcing the sled element to move rearward, withdrawing the pull-rod by the pull-ring which is jointly attached to the sled's medial hitch and the pull-rod, therein quickly reaching the limit of travel, whereupon the pull-rod releases the firing pin, which is forced by the spring into the primer, which fires with a flame and an explosive shock, that will ignite an attached fuse or an attached shock tube.

* * * * *